US005113983A

United States Patent [19]

Workman

[11] Patent Number: 5,113,983

[45] Date of Patent: May 19, 1992

[54] FRAME FOR SOFT LUGGAGE CASE

[75] Inventor: David E. Workman, Evergreen, Colo.

[73] Assignee: Samsonite Corporation, Denver, Colo.

[21] Appl. No.: 670,126

[22] Filed: Mar. 15, 1991

[51] Int. Cl.[5] ..... A45C 3/00; A45C 13/00

[52] U.S. Cl. ..... 190/127; 190/111; 190/113; 190/122; 220/9.1

[58] Field of Search ..... 190/24, 109, 111, 113, 190/122, 123, 124, 125, 127; 220/9.1, 9.2

[56] References Cited

U.S. PATENT DOCUMENTS

| | | | |
|---|---|---|---|
| 1,148,948 | 8/1915 | Benjamin | 220/9.1 |
| 1,742,204 | 1/1930 | Finkelstein | 190/127 |
| 2,146,658 | 2/1939 | Stanley | 190/127 |
| 2,481,565 | 9/1949 | Boretz | 190/903 |
| 3,305,052 | 2/1967 | Kish, Jr. | 190/113 |
| 3,306,329 | 2/1967 | Braun | 220/9.2 |
| 3,977,501 | 8/1976 | Alonso | 190/127 |
| 4,176,734 | 12/1979 | Wang | 190/127 |
| 4,418,804 | 12/1983 | Bradley et al. | 190/127 |
| 4,433,760 | 2/1984 | Pelavin | 190/127 |

FOREIGN PATENT DOCUMENTS

| | | | |
|---|---|---|---|
| 519374 | 4/1955 | Belgium | 190/113 |
| 272398 | 6/1927 | United Kingdom | 190/127 |

*Primary Examiner*—Gary E. Elkins
*Attorney, Agent, or Firm*—Gregory W. O'Connor

[57] ABSTRACT

Frames for softsided luggage usually comprise a hoop-shaped member of extruded plastic or metal attached to a bottom board to which in turn is attached wheels or the like. The means of attachment between this frame member and bottom board leads to aesthetic problems with regard to cluttered interior space. Disclosed is a luggage case and frame construction wherein the downwardly directed leg members of an extruded frame member terminate in splayed or outwardly directed attachment feet. Each attachment foot thus is positioned and permanently fixed to an end portion of the bottom board. Adjacent to the leg member is a divider panel, preferably in the form of a pouch-like cloth construction, which is attached to the associated end panel and forms an auxiliary compartment accessible through the end panel via a zipper. The pouch-like construction rests directly on the attachment foot, at least partially covering it, thus avoiding the addition of a cloth panel or auxiliary board for that purpose. The central area of the case remains uncluttered because of the unique attachment arrangement dislcosed.

12 Claims, 2 Drawing Sheets

FRAME FOR SOFT LUGGAGE CASE

BACKGROUND OF THE INVENTION

This invention relates to luggage, specifically so-called softsided luggage generally constructed of cloth panels stitched together to form a parallelopiped shaped cloth bag suspended on an interior frame. The frame provides general structural stability to the otherwise flaccid cloth bag, and also provides a structural member to which can be attached a handle for carrying and wheels for easy transportation.

Typically a soft luggage case of the type described above has a bottom board made of honeycomb extruded thermoplastic or more preferably a rectangular sheet of plywood. This plywood member is covered with cloth or vinyl compatible with the rest of the case and riveted in the bottom of the bag-like cloth construction. The bottom board may also bear two or four wheels for transporting the case. Also typically, the upper surface bottom board carries a hoop-shaped frame member. This frame member is fastened to the top surface of the plywood bottom board inside the luggage case with a handle or other attachements riveted through the frame member, through the body of the case, into the outside of the case construction. This frame member may be steel, metal or plastic and consequently is usually also covered with cloth material since the frame member may be rough or presumed to have sharp surfaces which would be undesirable to the user placing clothing or other personal items in contact with the frame. The attachment areas where the frame member and the bottom board come together present further aesthetic and functional problems. The end surfaces tend to be rough and thus require further covering to prevent contact of these rough edge surfaces with the personal effects to be transported in a luggage case.

A new type of luggage has been made popular by Samsonite Corporation, Assignee of the subject invention. This case, popularized under the term "Ultralite" luggage, includes outside accessible pouch-type pockets on the small rectangular end panels of the luggage case. The outside access to these pouch-like pockets is important for convenience of the user. Thus the end pockets must be placed outside the frame. This results in the end pockets being subject to drooping and being unsupported by the bottom board.

BRIEF DESCRIPTION OF THE INVENTION

The instant invention overcomes these aesthetic and functional disadvantages by providing an outwardly directed attachment foot on the end of the generally U-shaped frame member whereby the attachment mechanisms and the end surfaces of the U-shaped frame member are isolated from the main packing compartment (as defined by the spaced within the bottom board and U-shaped frame member), and further provides an opportunity for extending the bottom board beyond the normal outer periphery of the frame member so that end pockets of the type set forth above can be supported. Also, the pouch-like pocket provides automatic or ready covering for the otherwise rough or at least aesthetically unpleasant end portions of the frame member.

Accordingly, the instant invention comprises a soft luggage case made of fabric with a frame supporting the luggage case body. The case body has at least one end panel. The frame comprises a bottom board extending substantially the length and width of the body of the luggage case. This bottom board has a firs end portion at one end of the bottom board and a second end portion at the other end of the bottom board. This first end portion terminates approximate to the one end panel. There is a frame member attached to the bottom board at each end portion thereof, this frame member including leg members extending upwardly from the bottom board. The lower end of at least the first of these leg members has an attachment foot at a substantial right angle to that leg member. Fastening means for attaching the attachment foot to the bottom board end portion is provided, with the attachment foot being directed outwardly from the frame member towards the one end panel and overlying the first end portion of the bottom board.

Preferably, the frame member comprises a generally U-shaped construction having a longitudinally extending upward portion connecting the two leg members. Each of the leg members has an attachment foot which extends outwardly away from one another. This frame member preferably comprises an extruded profile of generally uniform cross-sectional shape, which has spaced longitudinal edges, a pair of grooves formed into one face of the extrusion. This pair of grooves are spaced one from another by an oppositely directed ridge.

The one end panel includes means such as a zipper for providing selective access therethrough to an end pocket which is at least partially defined by an interior panel which is positioned between the first leg member and the one end panel. In the preferred embodiment, the interior panel is in the form of a pouch-like cloth construction attached to the one end panel, the pouch having a lower end which is positioned directly over the attachment foot of the associated first leg member. In this way, the pouch-like interior panel covers the attachment foot.

DETAILED DESCRIPTION OF THE PREFERRED EMBODIMENT

Figure 1:
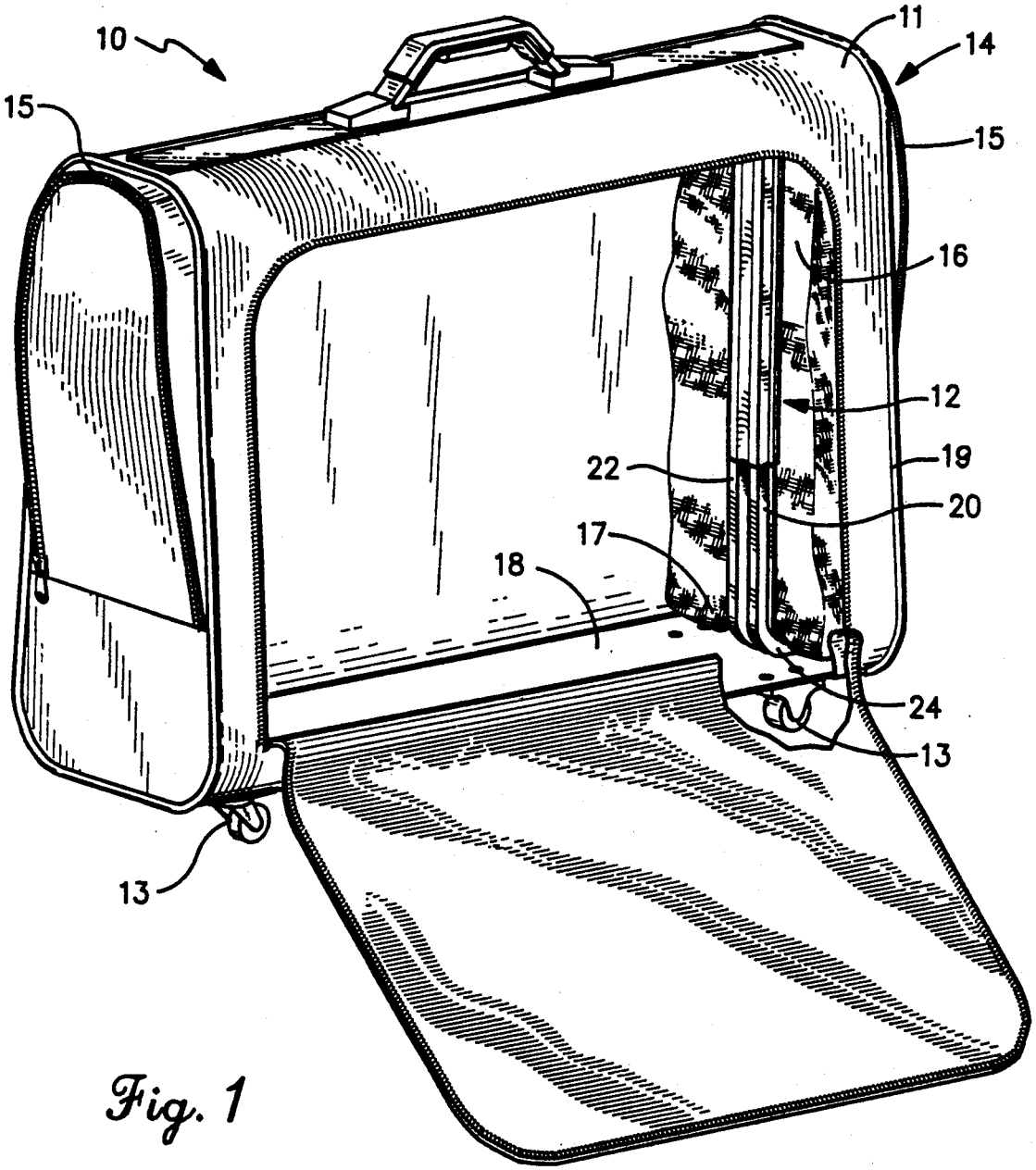
FIG. 1 shows the overall case, in a partially broken away view, claimed in the instant invention.

The luggage case 10 is of generally known construction, having a cloth body 11 supported on a frame 12 attached to the interior of the cloth body with rivets, bolts, etc. The case 10 includes at least one end panel 14, fastened to the rest of the case body by seam 19, which in turn has a selectably openable access means such as zipper 15. As with many luggage cases, plurality of wheels or casters 13 are provided for easy transportation.

Figure 2:
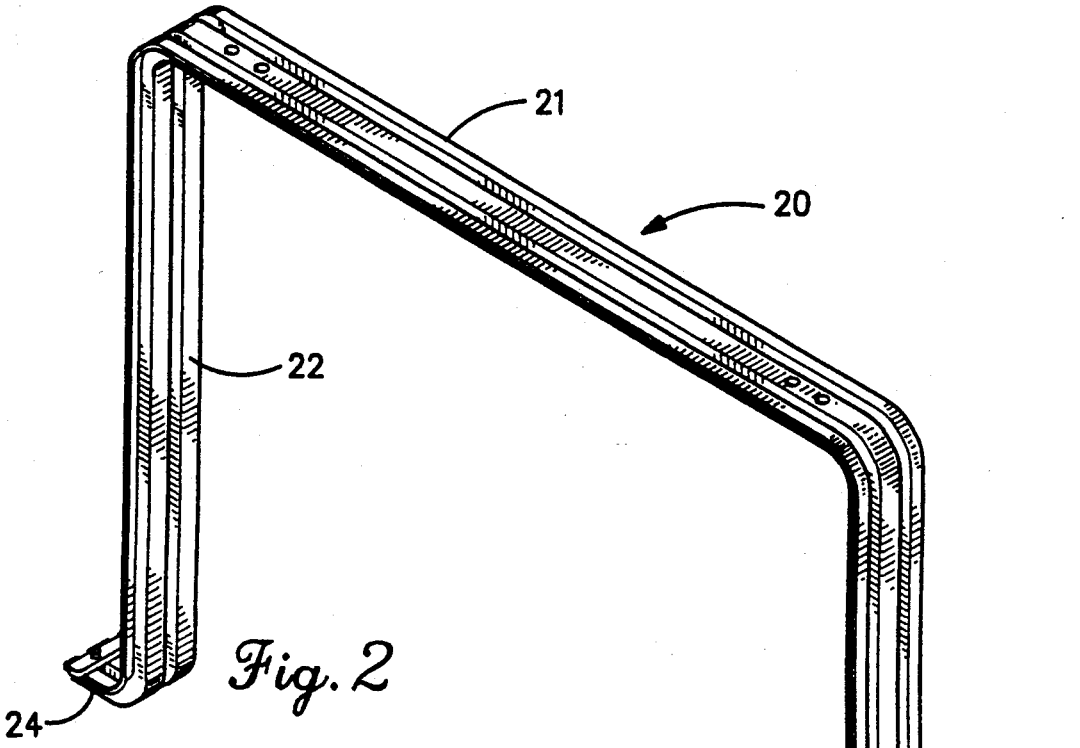
FIG. 2 shows a the frame of the luggage case of FIG. 1.
Figure 3:
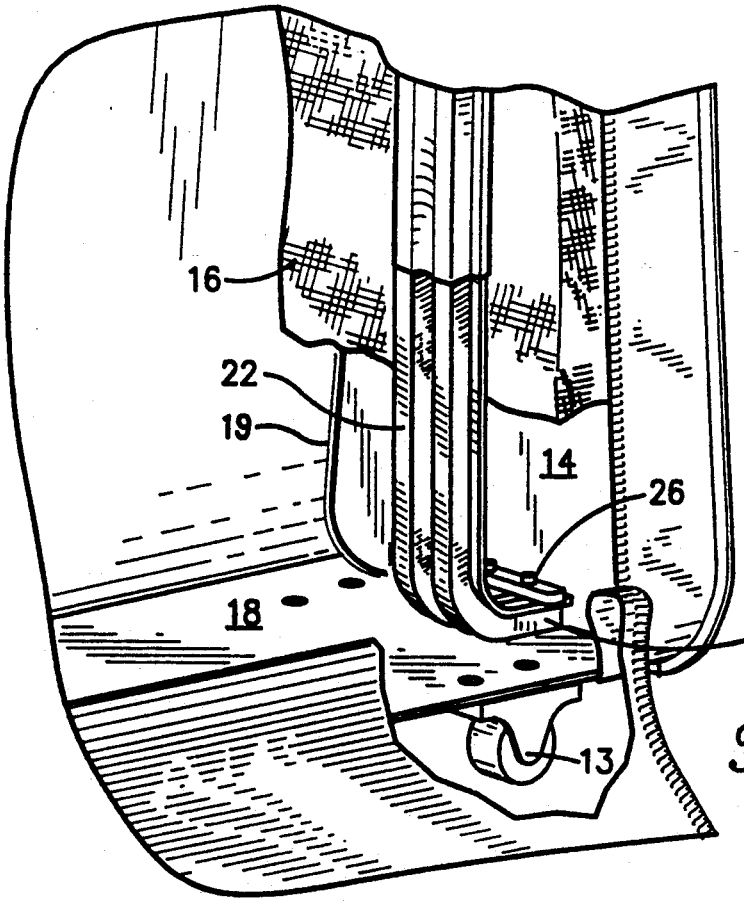
FIG. 3 shows details of the case shown in FIG. 1, again in a broken away view.

The frame 12, seen in FIG. 1 through the open packing door of the case, comprises a bottom board 18 which extends substantially the entire width of the case and preferably the entire length from end panel to end panel. Affixed to the bottom board 18 and extending upwardly therefrom is a frame member 20 comprising a horizontally extending upper portion 21 and depending first and second leg members 22 and 22. At the lowermost ends of each leg member is an attachment foot 24. As will be detailed, this attachment foot extends at a substantial right angle to the leg member 22 and in a direction away from the upper section 21. As seen in FIG. 2, the frame 20 preferably has two feet 24. These attachment feet are pointed away from one another. A pouch-like auxiliary compartment is accessible through the end panels of the luggage case while simultaneously simplifying the overall construction of the case. Referring to FIG. 3, the divider panel 16 is shown positioned between the end panel 14 and the leg member 22. Preferably, divider panel 16 is in the form of a pouch-like cloth construction which extends from the mutual seam 19 between the end panel and the rest of the body of the luggage case. Thus, divider panel 16 forms a pouch-like compartment, the lower end of which (17 of FIG. 1) rests directly on outwardly directed attachment foot 24 at the lower end of the leg member 22.

The attachment foot 24 is fastened to the bottom board using rivets, bolts, etc., of known type. The attachment means includes bolts 26 which pass into the pair of parallel channels 28 integrally formed into frame 20 via a profile extrusion process. It has been found desirable to include a metal bar or the like 27 to spread the forces of attachment throughout the extruded profile of the attachment foot 24.

Wheel units 13 are riveted or otherwise attached using conventional methods to the cloth body of the luggage case and the bottom board 18 in a known manner. They are preferably positioned at least partially below the end portion of the bottom board 18. In contrast to that shown in U.S. Pat. No. 3,977,501, the luggage construction according to the instant invention eliminates the need for hiding or camouflaging the attachment mechanism between frame member 20 and the bottom board 18. The divider panel 16, especially when it is in the form of loose, pouch-like cloth construction, masks the attachment foot and bolts used to hold it in place on the bottom board 18 over the end portion of the bottom board. The major area of the bottom board 18 remains uncluttered by all but an occasional rivet head associated with the attachment of the wheels 11.

I claim:

1. A soft luggage case comprising a case body made of fabric and a frame for supporting said body, said case body having at least one end panel, the frame comprising a bottom board extending substantially the length of the body of the luggage case; the bottom board having a first end portion at one end of the bottom board and a second end portion at the other end, the first end portion terminating approximate to said one end panel, and a frame member attached to the bottom board at each said end portion thereof, said frame member including leg members extending upwardly from said bottom board, the lower end of at least a first of said leg members having attachment foot formed at a substantial right angle to the leg member to which it is attached, and fastening means for attaching the attachment foot to the bottom board end portion, the attachment foot being directed outwardly from said frame member towards said one end panel and overlying said first end portion.

2. A soft luggage case as set forth in claim 1 wherein said frame member comprises a generally U-shaped construction having a longitudinally extending upper portion connecting the leg members, and wherein each of said leg members has an attachment foot which extends outwardly away from one another.

3. A soft luggage case as set forth in claim 2 wherein said frame member comprises a thermoplastic extruded material.

4. A soft luggage case as set forth in claim 3 wherein said thermoplastic extruded frame member has a cross section of generally uniform cross sectional shape having spaced longitudinal edges, and a pair of grooves formed into one face of said extrusion, said pair of grooves being spaced from one another by an oppositely directed ridge.

5. A soft luggage case as set forth in claim 4 wherein said fastening means are positioned one in each of said grooves.

6. A soft luggage case as set forth in claim 1 further including an interior panel, and wherein said one end panel includes means for providing selective access therethrough to an end pocket at least partially defined by said interior panel, said interior panel being positioned between said first leg member and said one end panel.

7. A soft luggage case as set forth in claim 1 wherein said end panel is attached to the rest of said case body by a seam.

8. A soft luggage case as set forth in claim 7 further including an interior panel, said one end panel includes means for providing selective access therethrough to an end pocket at least partially defined by said interior panel, said interior panel being positioned between said first leg member and said one end panel, and wherein said interior panel is in the form of a pouch-like cloth construction attached to said one end panel at said seam, said pouch having a lower end which is positioned directly over said attachment foot associated with said first leg member, whereby said pouch-like interior panel covers said attachment foot.

9. A soft luggage case as set forth in claim 8 wherein said first end portion of said bottom board extends beneath said pouch-like interior panel.

10. A frame member for a luggage case comprising a generally U-shaped construction having a longitudinally extending portion connecting two leg members extending generally perpendicular to said longitudinally extending portion, and wherein each of said leg members has an attachment foot at an end remote from said longitudinally extending portion, each said foot having spaced longitudinal edges, and a pair of grooves formed into a side thereof, each said foot extending from one of said leg members generally parallel to said longitudinally extending portion and outwardly away from one another.

11. A frame member as set forth in claim 10 wherein said frame member comprises a continuous, thermoplastic, extruded material.

12. A frame member as set forth in claim 11 wherein said frame member has a substantially uniform cross sectional shape having spaced longitudinal edges and a pair of grooves formed into one face of said extrusion, said pair of grooves being spaced from one another by an oppositely directed ridge.

* * * * *